US006918711B2

(12) United States Patent
Fuller

(10) Patent No.: US 6,918,711 B2
(45) Date of Patent: Jul. 19, 2005

(54) HAND-HELD SELF-DISPENSING APPLICATOR

(76) Inventor: Douglas D. Fuller, 68 Woodwells Garrison Rd., Contoocook, NH (US) 03229

( * ) Notice: Subject to any disclaimer, the term of this patent is extended or adjusted under 35 U.S.C. 154(b) by 0 days.

(21) Appl. No.: 10/821,686

(22) Filed: Apr. 9, 2004

(65) Prior Publication Data

US 2004/0218966 A1 Nov. 4, 2004

Related U.S. Application Data

(60) Provisional application No. 60/466,365, filed on Apr. 29, 2003.

(51) Int. Cl.[7] ..... B43K 5/04

(52) U.S. Cl. ..... 401/145; 401/184; 401/187

(58) Field of Search ..... 401/143, 145, 401/184, 187, 188 R, 189, 190, 200, 201; 222/95, 105, 209, 212, 386.5

(56) References Cited

U.S. PATENT DOCUMENTS

| | | | | |
|---|---|---|---|---|
| 2,143,601 | A | * 1/1939 | Iversen | 401/145 |
| 2,693,172 | A | * 11/1954 | Miessner | 401/145 |
| 3,617,139 | A | * 11/1971 | Ross | 401/201 |
| 4,207,909 | A | 6/1980 | Wilcher | |
| 4,557,620 | A | * 12/1985 | Hancy | 401/200 |
| 4,784,652 | A | * 11/1988 | Wikstrom | 222/386.5 |
| 5,308,181 | A | 5/1994 | Hull et al. | |
| 6,036,391 | A | * 3/2000 | Holliday et al. | 401/188 R |
| 6,039,491 | A | 3/2000 | Badillo | |
| 6,056,470 | A | 5/2000 | Nehashi et al. | |
| 6,142,695 | A | * 11/2000 | Byun | 401/188 R |
| 6,247,862 | B1 | 6/2001 | Garza | |
| 2001/0003565 | A1 | 6/2001 | McOsker et al. | |
| 2001/0010316 | A1 | 8/2001 | Parsons et al. | |
| 2001/0048841 | A1 | 12/2001 | Girardot et al. | |
| 2002/0042598 | A1 | 4/2002 | Reese | |
| 2002/0127044 | A1 | 9/2002 | Sorrell | |
| 2002/0150418 | A1 | 10/2002 | Sorrell | |

FOREIGN PATENT DOCUMENTS

| | | |
|---|---|---|
| DE | 197 16 052 A1 | 10/1998 |
| FR | 2 628 394 A1 | 9/1998 |
| GB | 2 370 223 A | 6/2002 |

* cited by examiner

*Primary Examiner*—Tuan Nguyen
(74) *Attorney, Agent, or Firm*—Maine & Asmus

(57) ABSTRACT

The applicator includes a housing having an outer surface, and an internal reservoir for holding the dispensable product (e.g., liquid soap or topical skin treatment or any flowable product). Porous qualities of the housing fluidly couple the internal reservoir and the outer surface of the housing. Thus, when the applicator is activated by creating an internal positive pressure, the product continuously flows (e.g., for 10 seconds or more) from the internal reservoir to the outer housing surface. A rapid product release (e.g., 1 to 9 seconds) is also possible. One or more porous housing jackets may be disposed about the housing, which operate in conjunction with the porous housing to control flow of product. The applicator can be designed as a one-time disposable device that includes an internal supply of product, avoiding the need for both applicator and separate product. Alternatively, the applicator can be designed to be rechargeable with a particular product or products.

30 Claims, 7 Drawing Sheets

Fig. 1e
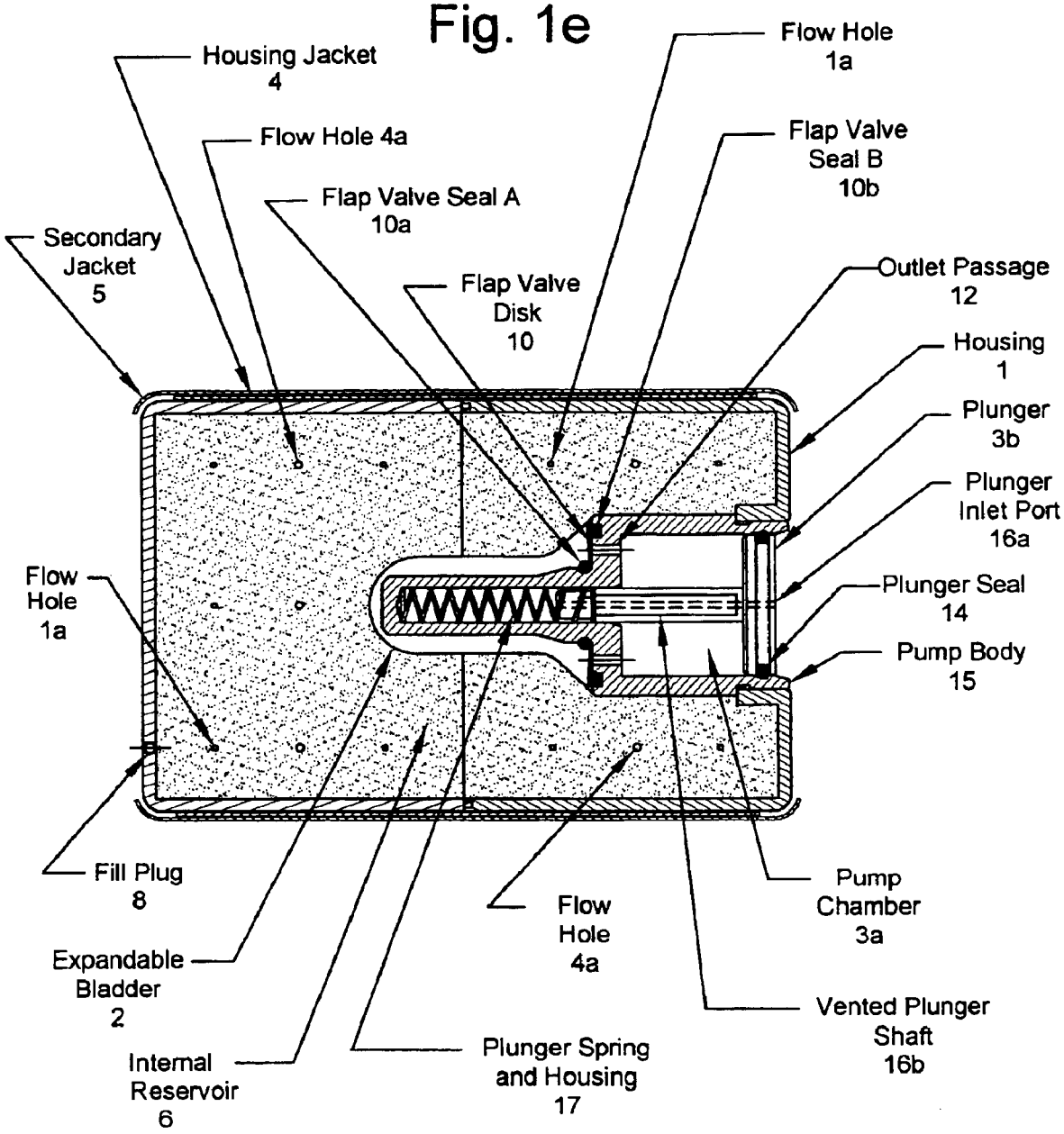
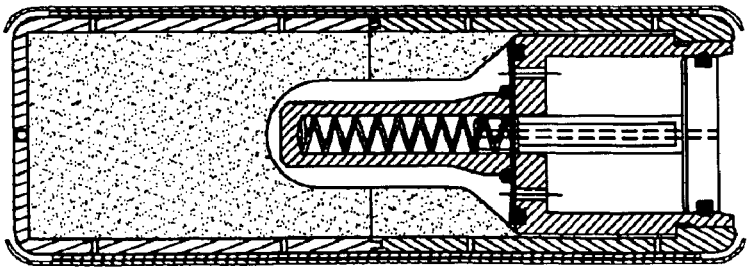
Fig. 1f

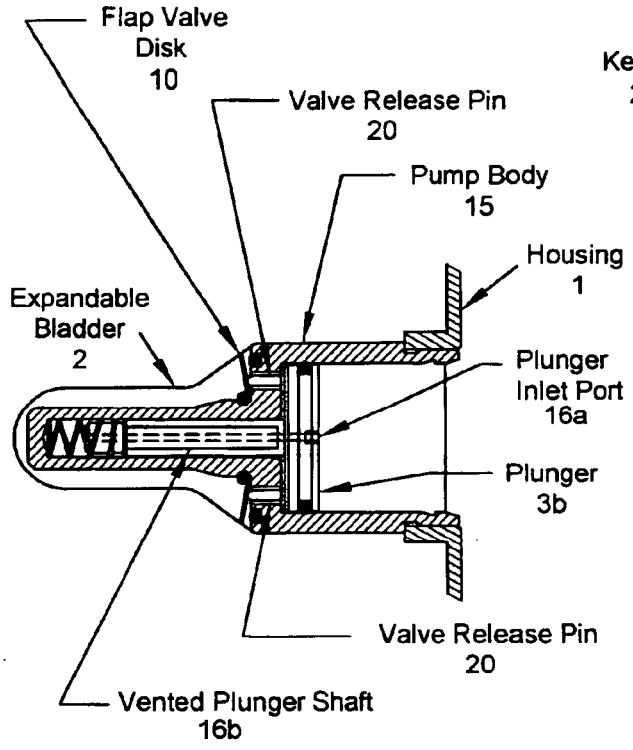
Fig. 1h
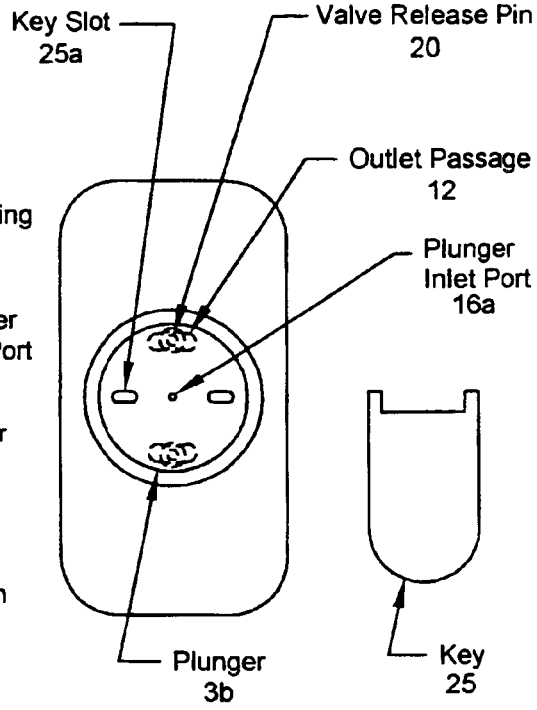
Fig. 1j
Fig. 1k
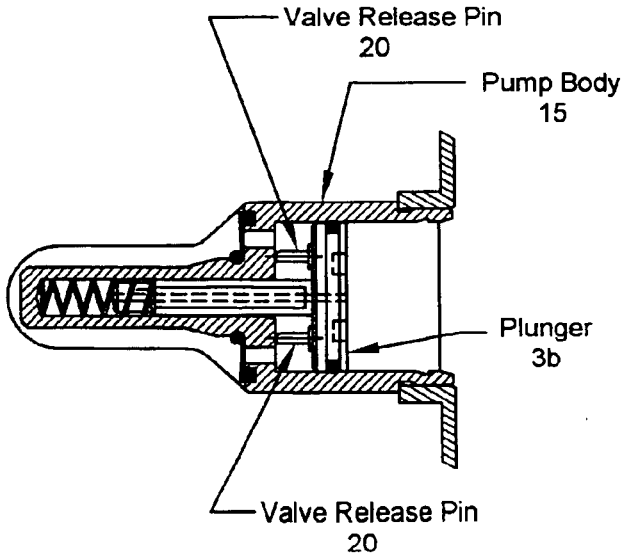
Fig. 1m
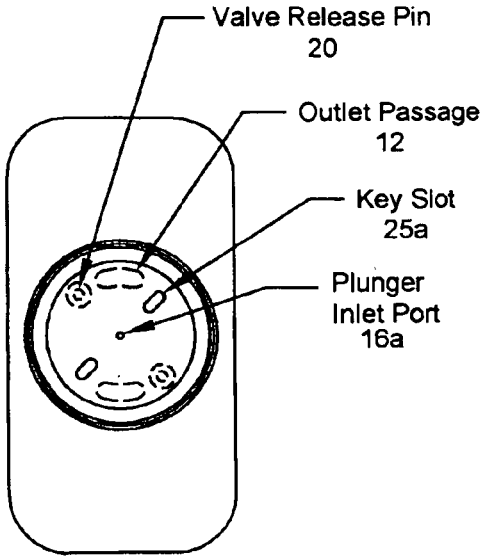
Fig. 1n

HAND-HELD SELF-DISPENSING APPLICATOR

RELATED APPLICATIONS

This application claims the benefit of U.S. Provisional Application No. 60/466,365, filed Apr. 29, 2003, which is herein incorporated in its entirety by reference.

FIELD OF THE INVENTION

The invention relates to applicators, and more particularly, to a hand-held dispensing applicator that can be used in a number of tasks, including bathing, applying skin treatments, and other such tasks.

BACKGROUND OF THE INVENTION

Conventional applicators typically rely on one of two methods of product application. One such method involves the consumption of the applicator itself. Example applicators that employ this method include bar soap. In such cases, the product being used or applied effectively operates as an applicator. The application process involves dissolving or erosion of the product, often times with the help of a secondary fluid such as water.

The second product application method uses the applicator as a carrier for the product to be applied. Examples here include a washcloth, loofah, scrunchy, sponge, or other carrying device used with various types of soap (e.g., bar, liquid, and paste) and water. In one particular example, the soap product can be can be placed in a pocket area of the carrying device. Alternatively, the soap product can be applied to the carrying device prior to each use.

Each of the above application methods is associated with a number of problems. For example, as a soap bar or other consumable applicator is used, it changes shape and becomes smaller, eventually becoming too small for convenient use. In addition, conventional bar soaps change characteristics if left in contact with water, becoming mushy or otherwise unusable. Moreover, a conventional soap bar leaves soap residue on surfaces in the washing area and on surfaces used to hold it between uses. Also, certain dispensable products do not lend themselves to use in a solid form (e.g., liquid cleaning agents).

Carrier-type applicators are less convenient than consumable applicators, in that they require soap (or other product) to be regularly reloaded during any one session of use. Carrier-type applicators that have a pocket for holding the applied product essentially suffer the same problems as discussed in reference to consumable applicators, such as soap residue and decreasing product size. In addition, they are prone to odor (e.g., stale washcloth or sponge).

Another applicator type, which is generally used to operate on a work surface, is a hand-held device having a single surface that delivers a product from an internal reservoir. The single surface typically has a cluster of apertures through which the product is released. Such applicators are typically used for cleaning or otherwise operating on surfaces (e.g., countertops, woodwork, or leather), or for use on livestock (e.g., grooming or cleaning). As the dispensing side of applicator is pressed to the target surface, the pressure of the user's hand on the non-dispensing side causes the product to be squeezed out through the apertures to the target surface.

These applicator types are generally designed to protect the user's hand from coming into contact with the product being dispensed, and are therefore configured with a limited dispensing area. In addition, they lack internal positive pressure, thereby allowing external material to intermingle with the product within the applicator. In particular, when the user's hand releases pressure on the non-dispensing side of the applicator, external material such as secondary fluids (e.g., water) or debris from the target surface, is pulled into or toward the internal reservoir. The purity of the unused product internal to the applicator is thus compromised.

What is needed, therefore, is a dispensing applicator that can be effectively used in applying products such as soap and medicine to the skin of a user/patient, where the applicator does not change size after use.

SUMMARY OF THE INVENTION

One embodiment of the present invention provides a hand-held self-dispensing applicator device. The device includes a housing having an outer surface and an internal reservoir for holding dispensable product, wherein a plurality of pores fluidly couple the internal reservoir and the outer surface of the housing. A bladder in included within the internal reservoir. A pressure inducing mechanism is operatively coupled to the bladder, and is adapted to increase pressure within the bladder so as to provide a positive pressure in the internal reservoir, thereby causing the product to flow through the plurality of pores to the outer surface of the housing.

The device may further include a housing jacket disposed on the outer surface of the housing. The jacket can be adapted to provide a soft and resilient application surface. The jacket can be adapted to control the flow of the product through the plurality of pores to the outer surface of the housing. In one such embodiment, the housing jacket includes a number of flow holes (e.g., punctures, slits, holes) that are substantially offset from the plurality of pores. The housing jacket can be adapted to operate in conjunction with the positive pressure in the internal reservoir to control the flow of the product through the plurality of pores, as well as to inhibit flow of secondary fluids into the internal reservoir. The housing jacket can be adapted to operate in conjunction with physical attributes of the product to control the flow of the product through the plurality of pores.

The pressure inducing mechanism may include, for example, at least one of the following: a pump chamber and plunger arrangement, a one-way valve scheme, a seal and retention scheme, and an external charging station. Alternatively, the pressure inducing mechanism may include a pressurized container that is forced into releasing its contents at least partially thereby increasing the inner pressure of the bladder. Alternatively, the pressure inducing mechanism is adapted to exploit by-products of a chemical reaction to increase the inner pressure of the bladder. The pressure inducing mechanism can be activated by a user.

Another embodiment of the present invention provides a hand-held self-dispensing applicator device. The device includes a housing having an outer surface and an internal reservoir for holding dispensable product, wherein a plurality of pores fluidly couple the internal reservoir and the outer surface of the housing. A pressure inducing mechanism is adapted to provide a positive pressure in the internal reservoir which causes the product in the internal reservoir to flow through the plurality of pores to the outer surface of the housing. In one such embodiment, the pressure inducing mechanism includes at least one of a pump chamber and plunger arrangement, a one-way valve scheme, a seal and retention scheme, and an external charging station. In one particular embodiment, the pressure inducing mechanism includes a pump chamber and plunger arrangement configured to operate in conjunction with a one-way flap valve. The device may further include a housing jacket disposed on the outer surface of the housing, where the jacket is adapted to control the flow of the product through the plurality of pores to the outer surface of the housing. The housing jacket may include, for instance, a number of flow holes that are substantially offset from the plurality of pores. The housing jacket can be adapted to operate in conjunction with the positive pressure in the internal reservoir and/or with the physical attributes of the product to control the flow of the product through the plurality of pores.

Another embodiment of the present invention provides a hand-held self-dispensing applicator device. This particular embodiment of the device includes a housing having an outer surface, and an internal reservoir for holding dispensable product, wherein porous qualities of the housing fluidly couple the internal reservoir and the outer surface. A bladder within the internal reservoir, is configured to provide a positive pressure in the internal reservoir, which causes the product in the internal reservoir to flow to the outer surface of the housing. In one particular case, the porous qualities are provided by a plurality of flow holes in the outer surface.

Another embodiment of the present invention provides a hand-held self-dispensing applicator device. This particular embodiment of the device includes a housing having an outer surface, and an internal reservoir for holding dispensable product, wherein porous qualities of the housing fluidly couple the internal reservoir and the outer surface. Here, the internal reservoir can be pressurized to provide a positive pressure in the internal reservoir that causes the product in the internal reservoir to continuously flow to the outer surface of the housing for a period of 10 seconds or more. The porous qualities of the housing are provided, for example, by a plurality of flow holes in the outer surface. The device may further include a housing jacket disposed on the outer surface of the housing, where the jacket adapted to control and/or restrict the flow of the product to the outer surface of the housing. The housing jacket may be adapted to operate in conjunction with the positive pressure in the internal reservoir to control the flow of the product to the outer surface of the housing, as well as to inhibit flow of secondary fluids into the internal reservoir. The housing jacket may be adapted to operate in conjunction with physical attributes of the product to control the flow of the product to the outer surface of the housing.

Another embodiment of the present invention provides a hand-held self-dispensing applicator device. This particular embodiment of the device includes a housing having an outer surface and an internal reservoir for holding dispensable product, wherein a plurality of pores fluidly couple the internal reservoir and the outer surface. A pump chamber and plunger arrangement is configured to operate in conjunction with a one-way valve to provide a positive pressure in the internal reservoir which causes the product in the internal reservoir to continuously flow through the plurality of pores to the outer surface of the housing for a period of 10 seconds of more. Note, however, that other embodiments may be configured to release substantially all product in a shorter period of time (e.g., 1 to 9 seconds). Such an embodiment may be useful, for example, in a medical application where an instantaneous or rapid product release would be beneficial to timely treating a skin condition (e.g., chemical exposure).

The device may further include a bladder within the internal reservoir that is operatively coupled to the pump chamber, thereby enabling expansion of the bladder so as to provide the positive pressure in the internal reservoir. The device may further include a housing jacket that is disposed on the outer surface of the housing, where the jacket adapted to operate in conjunction with the positive pressure in the internal reservoir to control the flow of the product through the plurality of pores, as well as to inhibit flow of secondary fluids into the internal reservoir. The housing jacket may include, for example, a number of flow holes that are substantially offset from the plurality of pores.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIGS. 1*a*, 1*b*, 1*c*, 1*d*, 1*e*, and 1*f* illustrate various views of self-dispensing applicators configured in accordance with various embodiments of the present invention.

FIGS. 1*h*, 1*j*, 1*k*, 1*m*, and 1*n* illustrate a discharge mechanism configured in accordance with an embodiment of the present invention.

DETAILED DESCRIPTION OF THE INVENTION

Figures 1A, 1B:
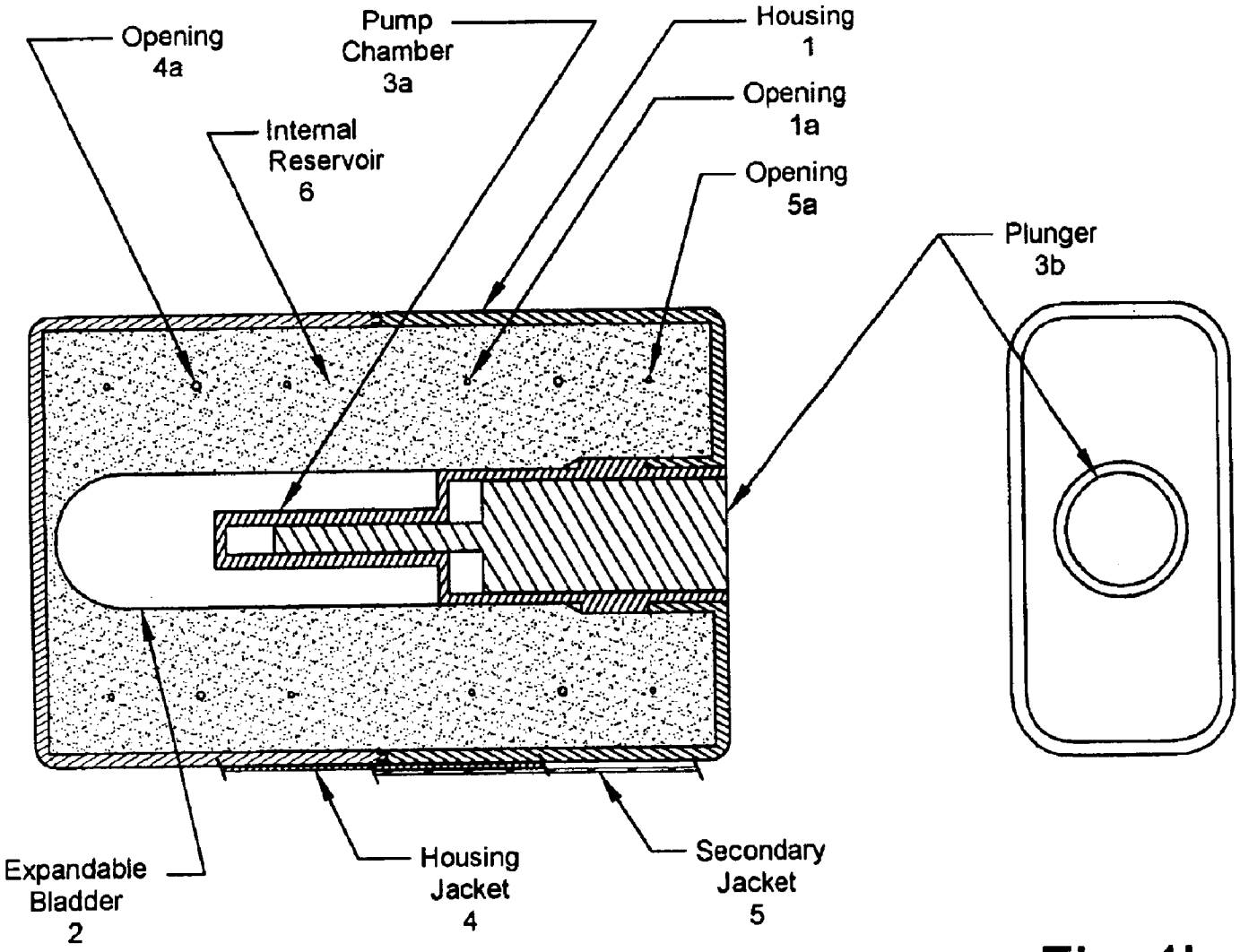

Embodiments of the present invention described herein provide a self-dispensing applicator device that dispenses a product from an internal reservoir. The product may be, for example, a liquid, foam, gel, paste, topical medicine or ointment, or any flowable product that could be applied using an applicator. Soaps, skin conditioners, disinfectants, skin or body treatments, neutralizing agents, liquid shields, hair mousse, liquid wax, liquid polish, surface cleaners, and livestock treatments may all be dispensed by the self-dispensing applicator.

General Overview

The self-dispensing applicator includes a housing having an outer surface, and an internal reservoir for holding the dispensable product. Porous qualities of the housing fluidly couple the internal reservoir and the outer surface.

In one embodiment, an expandable bladder is included within the internal reservoir. When the pressure inside the bladder is increased (e.g., by operation of a plunger and one-way valve system), the bladder expands, thereby providing a positive pressure within the internal reservoir. This positive pressure causes the product in the internal reservoir to ooze, weep, or otherwise flow to the outer surface of the housing by virtue of the housing's porous qualities. The user can activate and deactivate the self-dispensing applicator so as to start and stop the flow of product as desired. For instance, activating the device would involve charging the bladder (e.g., with air) to provide a positive pressure, while deactivating the device would involve discharging the bladder pressure.

In an alternative embodiment, the bladder pressure is maintained at a particular pressure, thereby leaving the bladder in a permanently expanded state within the reservoir. By loading the reservoir with a charge of product, the expanded bladder is effectively compressed, thereby creating a positive pressure within the internal reservoir. This positive pressure causes the product in the internal reservoir to flow to the outer surface of the housing by virtue of the housing's porous qualities. In such an embodiment, the user can charge the self-dispensing applicator with product just prior to use. The device can be designed for a particular product charge volume and flow rate so as to provide the user with an active session of a set period of time (e.g., 3 to 5 minute shower). If the internal positive pressure becomes insufficient to cause outward flow of product during use, then the user can re-charge the internal reservoir with product. Likewise, if the user finishes the session early, unused pressure can be relieved, for example, by engaging a relief valve.

In another embodiment, there is no bladder. Here, the internal reservoir is pressurized with the product itself prior to a session of use (e.g., via an external charging station configured to dispense pressurized product into the internal reservoir of the device). Here, the device is designed so that the housing is pliable and effectively expands when the pressurized product is forced into the internal reservoir. Thus, after charging the internal reservoir with product, the pliable housing (as well as any pliable housing jacket) will tend to constrict around the product within the internal reservoir, thereby creating an internal positive pressure. This positive pressure causes the product in the internal reservoir to flow to the outer surface of the housing by virtue of the housing's porous qualities. Just as with other embodiments, the user can re-charge the internal reservoir with product to continue use, or can engage a relief valve to discontinue use.

In any such embodiments, flow rates may be controlled by a combination of physical and chemical factors including applied pressure, product viscosity, product surface tension and elasticity, and porosity of the various parts of the self-dispensing applicator.

The porosity of the device may include a number of apertures on the various sides of the housing, each aperture having a size corresponding to the desired flow rate and product type. The porosity of the device may include a tiered design. For example, a first tier of coarse or "priming porosity" can be provided by apertures in one or more sides of the housing. A second tier of fine or "flow control porosity" can be provided by a housing jacket that is wrapped around the housing or otherwise disposed over the apertures of the housing. A third tier of fine or "flow control porosity" can be provided by a secondary housing jacket that is wrapped around the first jacket. Additional jackets can be added as desired to regulate flow and prevent entry of foreign matter (e.g., shower water) into the internal reservoir. Note that the porosity of a jacket layer can be attributed to holes or slits cut or formed into the jacket (e.g., rubber jacket with selectively placed pin holes), or can be attributed to the natural make-up of the jacket (e.g., terry cloth jacket with a porous weave).

The self-dispensing applicator may further include a storage wrapper or storage/charging station for proper device storage prior to use and/or between uses, depending on the product involved, the design of the device, and its intended storage and use. The size and shape of the device may vary greatly depending on application and specific needs and functions required for each application.

The device can be used in a number of applications. For example, the device can be used as a personal soap bar, where the internal reservoir is filled with liquid soap. A bather could activate the flow at the start of a bathing session, and deactivate the flow at the end. The device can then be rinsed clean, and stored for a future use. Note, however, that a deactivation feature is not necessary, in that the internal pressure can simply be allowed to dissipate naturally, thereby stopping product flow. Alternatively, the device can simply be intended for one use, thereby eliminating any post-use procedure or mechanisms. In another application, the device could be used as a medicinal applicator, where the internal reservoir is filled with a dispensable medicine or skin treatment. A medical professional or the patient could activate the device to deliver the medicine to the patient. After treatment, the device can be deactivated to stop the flow. In a similar application, the device can be loaded with a prescribed or otherwise measured amount of the product, and a given treatment session would conclude when the product in the reservoir was sufficiently dispensed. The spent device could then be discarded.

Numerous such applications will be apparent in light of this disclosure. Depending on the application, the internal reservoir of the device is fluidly coupled with the outer surface by way of the housing porosity on one or more sides of the housing. For instance, the self-dispensing device configured for a bathing application might have porosity on all sides of the housing to emulate an actual soap bar. A self-dispensing device configured for a medical application might have porosity on selected sides of the housing to prevent unwanted dispensing of the product on to the user's hand, or to otherwise protect the user's hand from contacting the product.

Device Structure—Disposable Application

FIGS. 1*a* and 1*b* illustrate top and end views respectively of a self-dispensing applicator configured in accordance with an embodiment of the present invention. This particular device design contains its own non-replenishable product supply (e.g., liquid soap) and is considered disposable. In addition, this design employs an indirect product displacement approach, utilizing an internal air pump to pressurize an internal bladder which pressurizes the product to initiate product displacement and flow. The device includes a housing 1, an expandable bladder 2, a pump chamber 3*a* and plunger 3*b*, a housing jacket 4, a storage or secondary housing jacket 5, and an internal reservoir 6 for containing the product.

The housing 1 can be formed, for example, from molded plastic pieces that snap or otherwise couple together. Alternatively, the housing 1 could be formed with a single molded piece of pliable elastomer or rubber. Alternatively, the housing 1 could be formed with a center molded piece of pliable elastomer or rubber and two plastic end pieces. Numerous materials can be used here, and the present invention is not intended to be limited to any particular one or combination.

The assembly techniques employed could include, for instance, solvent bonding, adhesive bonding, taping over joints, or any bond that provides structural integrity and a liquid seal. Alternatively, the housing jacket 4 could operate to hold the assembly together. For instance, a housing jacket having elastomeric qualities could be stretched over the housing so as to secure the assembly. In another such embodiment, a housing jacket made of a heat shrinkable tubing or fabric could be used, where the jacket is placed over the assembled housing, and then heat shrunk to secure the assembly. The housing 1 generally defines the basic shape and size of the device, and forms the internal reservoir 6 that contains the product. The shape and size may vary considerably depending on the application. In one particular case, the device is an elongated block, 100 mm×54 mm×32 mm, having a shape and size intended to be hand-held and similar to that of conventional bar soap.

The housing 1 has a plurality of small openings (e.g., openings 1*a*, which can be 200 to 1000 microns in diameter) or otherwise has porous qualities on one or more of its sides. In a bathing application where the internal reservoir is filled with liquid soap, the pores could be on all sides of the housing, so that the device would emulate a bar of soap. The housing is ultimate filled with the product through, for example, a pluggable opening or built-in valve. The pre-filled device can then be used.

Expandable bladder 2 is disposed within the internal reservoir 6. When the bladder 2 is pressurized (e.g., filled with air), a positive pressure is created in the internal reservoir 6. In one embodiment, the bladder 2 is elastomeric and expands freely when its internal pressure exceeds the internal reservoir 6 pressure. The shape and material of the bladder 2 may vary. For example, the bladder 2 may be a balloon type device, having a smooth outer surface that expands evenly. Alternatively, the bladder 2 may be a bellows type device, having convoluted sides. Alternatively, the bladder 2 may be an inflatable baggy that can be expanded from a collapsible position to an inflated position. Generally stated, the bladder 2 can be any device that can expand to generate a positive pressure within the internal reservoir 6, when the pressure within the bladder 2 is greater than the pressure within the internal reservoir 6.

Pump chamber 3*a* and plunger 3*b* cooperate with one another, where the plunger 3*b* can be pushed down into the pump chamber 3*a*, thereby causing pressure in the pump chamber 3*a*. The pump chamber is operatively coupled (e.g., via a one-way flap valve) to the inner area of the bladder 2. Thus, when the plunger 3*b* is depressed toward the pump chamber 3*a*, the pressure within the bladder 2 increases, and the bladder 2 expands accordingly. This expansion of bladder 2 causes the product in the internal reservoir 6 to flow to the outer surface of the housing 1 by virtue of the housing's porous qualities. Other pressure inducing mechanisms can be employed here as well as will be apparent in light of this disclosure (e.g., FIG. 2).

Other items of the pumping system, such as one-way valves, seals, and a retention system for the plunger may also be included in the design. Releasing and depressing the plunger 3*b* displaces air from outside the device into the bladder 2 which results in pressurization of the product contained in the reservoir 6. Depending on the application, the plunger 3*b* can be pushed down just once, thereby priming a one-shot disposable operation, or the plunger can be depressed (e.g., and spring returned) a number of times to prolong operation.

Note that for a one-shot operation, only a one-way valve for allowing air to flow from the pump chamber 3*a* into the bladder 2 would be required. Here, the volume of air pumped into the bladder 2 by depressing plunger 3*b* would be sufficient to cause the majority of the product to flow from the reservoir 6 to the outer surface of housing 1. For a configuration that allows the plunger 3*b* to be repeatedly pumped (more than just a single depression of plunger 3*b*), an inlet valve would also be required for letting air into the pump chamber 3*a* when the plunger 3*b* returns to its undepressed state (e.g., via operation of a spring or pulling by the user) so that it can be depressed again. Here, the volume of air pumped into the bladder 2 by depressing plunger 3*b* could be replenished as needed to keep a desired flow of product from the reservoir 6 to the outer surface of housing 1. A pump chamber configured with both inlet and outlet valves is discussed in reference to FIGS. 1*e* and 1*f*.

Optional housing jacket 4 may cover all or part of the device. The jacket may act as a cushion so the device feels soft and resilient (e.g., sponge-like or terry cloth). The jacket 4 can operate in conjunction with the porous qualities of the housing 1 and or the chemical/physical properties of the product, so as to provide a check valve to stop unintended product leakage out of the device when in a non-pressurized state, and to prevent intake of secondary fluids (e.g., water) to which the device is exposed during use into the reservoir 6 of the device.

Optional secondary jacket 5 can be used as a storage case. Alternatively, jacket 5 can be designed to control the release rate of product, independently or in collaboration with other device components as described in reference to jacket 4. Porosity, permeability and other characteristics of jacket 5 may be controlled and altered as a way of controlling and changing product flow or seepage rates. For instance, the tighter the weave density of the jacket 5 (assuming a fabric-type jacket), the greater the degree of flow resistance provided, and therefore the slower the flow rate. In addition, the surface texture and friction characteristics of jacket 5 may be used to enable the device to closely emulate the feel and performance of conventional bar soap, or an otherwise desired feel (e.g., loofah or terry cloth).

Note that the characteristics of jackets 4 and 5 can be combined into a single jacket, or assigned to respective jackets. For example, in one particular embodiment, the housing 1 has a plurality of holes (opening 1*a*) that provide a first seepage layer; the jacket 4 layer has a plurality of holes (openings 4*a*) that provide an intermediate seepage layer; and the jacket 5 has a plurality of holes (or porous characteristics) (openings 5*a*) that provide a third and outer seepage layer. The holes of each layer can be spaced so that direct alignment between layers is avoided, which will in-turn prohibit direct product flow from the reservoir 6 to the outer surface of the device, as well as intake of secondary fluids. Any one or combination of the jacket characteristics can be employed, but none are required for the present invention to operate. The optional housing jacket design scheme is a function of desired device performance, device feel, unit cost, and manufacturability. Numerous configurations will be apparent in light of this disclosure.

To use the self-dispensing applicator, the user would depress the plunger 3*b* into the pressure chamber 3*a* thereby pressurizing the bladder 2 and ultimately the product reservoir 6. The product (e.g., liquid soap) will then seep through the housing 1, jacket 4 and jacket 5 (assuming both jackets are employed), by virtue of the porous qualities associated with each. The flow rate and duration of flow is designed to match the intended application. For instance, a "shower bar" application might continuously release liquid soap at an acceptable rate for about 3 to 5 minutes and then stop. Recharging pressure by re-plunging may be performed as necessary, assuming the device is not a one shot configuration (single depression of plunger 3*b*).

Device Structure—Rechargeable

Figures 1C, 1D:
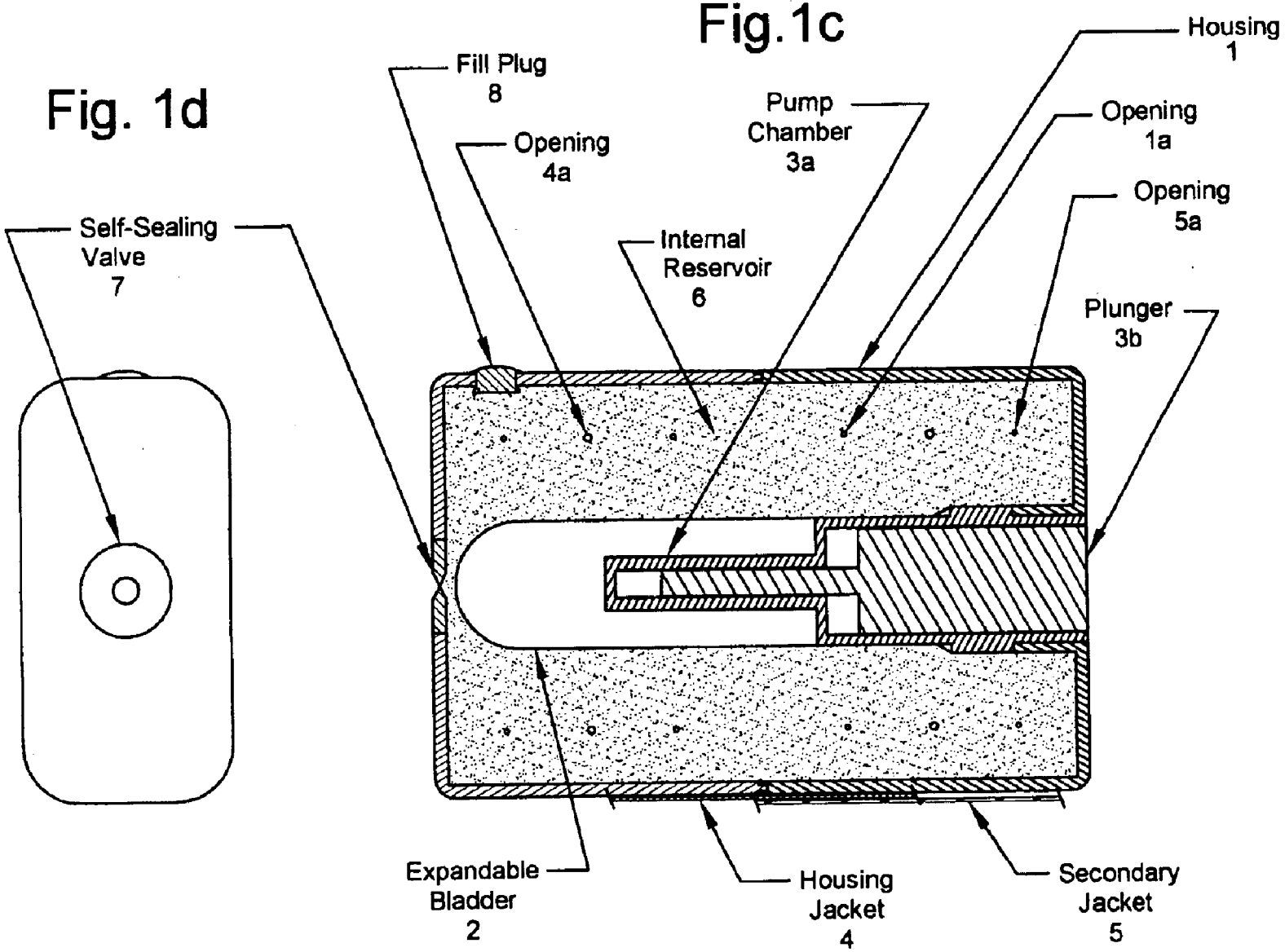

FIGS. 1*c* and 1*d* illustrate top and end views respectively of a self-dispensing applicator configured in accordance with another embodiment of the present invention. This particular device design is non-disposable, as it is adapted so that the dispensable product (e.g., liquid soap) can be replenished once the reservoir 6 is depleted. For the purposes of discussion, two mechanisms are illustrated for carrying out the replenishment, but only one is necessary.

In addition to the device features previously discussed, this particular embodiment further includes a self-sealing valve 7 and a fill plug 8. Thus, the reservoir 6 can be recharged with product by, for example, removing the fill plug 8, and manually pouring the product in, or injecting the product or other product from the product's primary storage container. Once the device is filled with the product, the fill plug 8 can be plugged back in position, and the device is ready for its next use.

Alternatively, the reservoir 6 can be recharged with product by coupling the device to a product charging station (e.g., FIGS. 3*a* and 3*b*) by way of the device's self-sealing valve 7. This valve can be made of resilient rubber that can be punctured by or otherwise yield to the charging nozzle of a recharging station. Once the reservoir 6 is recharged, the device can be withdrawn from the charging nozzle, and is ready for its next use.

Device Structure—Multi-Pump with Multi-layer Porosity

FIGS. 1*e* and 1*f* illustrate top and side views respectively of a self-dispensing applicator configured in accordance with another embodiment of the present invention. A multi-pump configuration is provided so that internal positive pressure can be maintained as needed. Also, a multi-layer porosity is provided to control the outward flow of product, and to prevent intake of secondary fluids. Note that this particular device can be configured to be rechargeable, as well as for disposable or non-disposable use, as previously discussed in reference to FIGS. 1*a–d*.

As previously discussed, the housing 1 can be formed, for example, from molded or machined pieces that couple together. The housing 1 pieces could, for example, be bonded together (e.g., using solvent, adhesive, or welds), or held together with a wrap of tape or by natural retention properties of housing jacket 4 and/or secondary jacket 5. Housing jacket 4 and secondary jacket 5 are installed over the housing 1 to provide a contiguous porous surface over the majority of the housing 1.

In particular, housing 1 includes a first set of flow holes 1*a*, each of which fluidly couple the internal reservoir 6 to the outer surface of housing 1. Housing jacket 4 further includes a second set of flow holes 4*a*, so as to provide an additional layer of porosity. In this example, note that flow holes 1*a* are smaller than the flow holes 4*a*. However, such a configuration is not necessary for the present invention to operate. For instance, the flow holes 1*a* and 4*a* can be about 250 to 1000 microns in diameter. Variations will be apparent in light of this disclosure. For example, the flow holes 4*a* of housing jacket 4 can be slits ranging from 500 to 3000 microns in length. Secondary jacket 5 is porous by virtue of its material make-up (as opposed to having flow holes), thereby providing an outer layer of porosity. Note, however, that secondary jacket 5 can also have flow holes instead of natural porosity.

The example pump assembly includes a pump body 15 with four outlet passages 12 (one in each quadrant of the pump body 15 base). Here, a flap valve design controls flow through the passages 12. In particular, flap valve disk 10 is a donut-like flexible disk having an inner diameter hole that fits over the plunger spring housing 17, so that the flap disk 10 can sit snugly at the base of the pump body 15. A flap valve seal 10*a* seals and retains the flap valve disk 10 against flap valve seal 10*b*. An outer diameter of the flap disk 10 extends over the outlet passages 12, which are positioned between the flap valve seals 10*a* and 10*b*. Thus, a one-way valve between the pump chamber 3*a* and the internal cavity of the bladder 2 is provided. The pump plunger 3*b* includes a plunger seal 14 and slides into the pump body 15 to define the pump chamber 3*a*. In this case, plunger seal 14 retains plunger 3*b* within chamber 3*a* when the plunger 3*b* is fully extended. The plunger 3*b* is further configured with a plunger inlet port 16*a* and a vented plunger shaft 16*b*. A plunger spring and housing 17 is provided at the base of the pump body 15 so as to spring load the vented plunger shaft 16*b*.

Figure 1G:
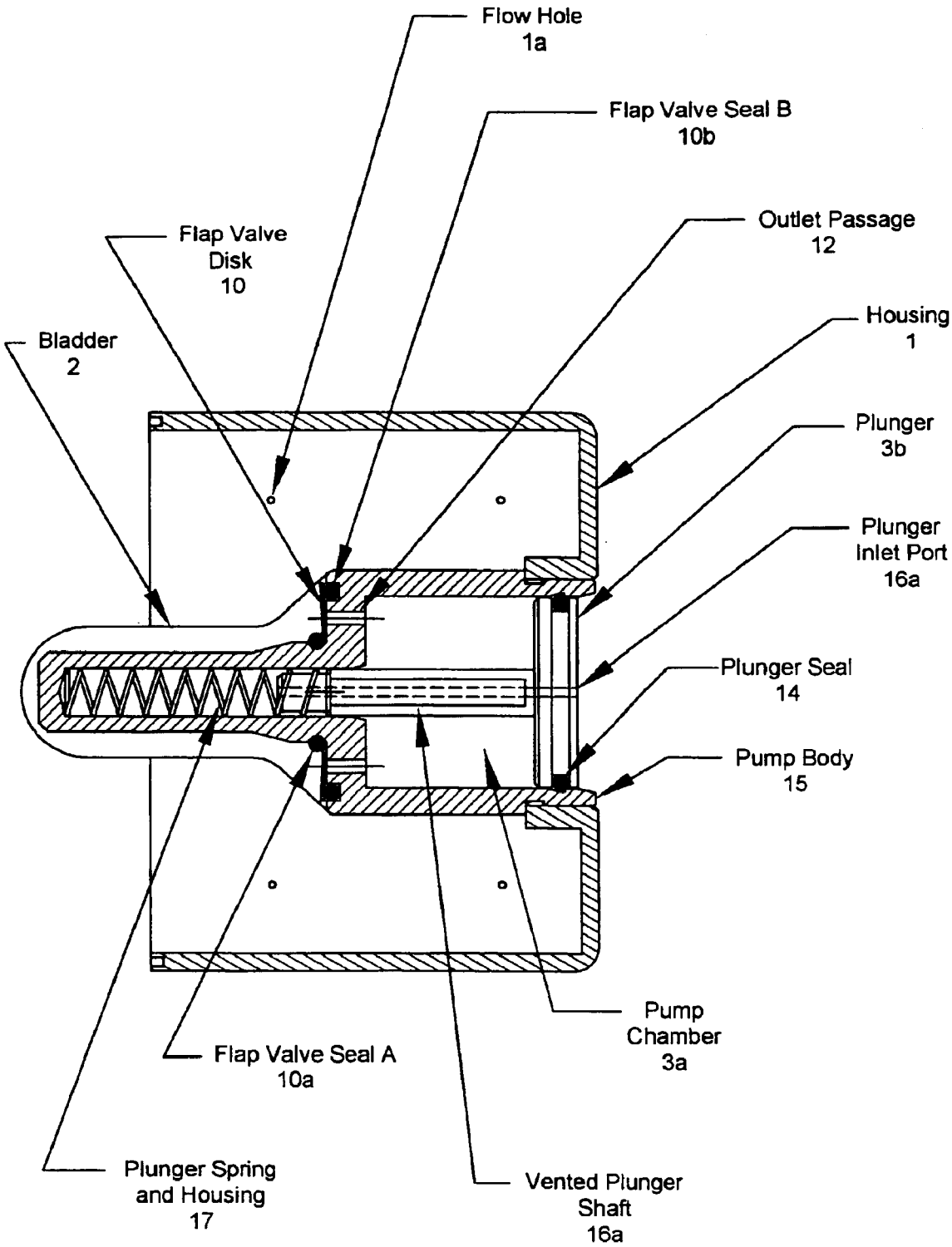
FIG. 1*g* illustrates an expanded view of a flap valve configured in accordance with an embodiment of the present invention.

An expanded view of the flap valve design and pump assembly is shown in FIG. 1*g*. Note how flap valve seal 10*a* (e.g., resilient rubber O-ring) snugly fits into a groove at the base of the plunger spring housing 17, so as to firmly hold the flap valve disk 10 in place. During a down stroke of the pump cycle, air in the pump chamber 3*a* is forced through the outlet passages 12, thereby causing the flap disk 10 to lift off of the flap valve seal 10*b* (e.g., resilient rubber O-ring) so that the compressed air from the pump chamber 3*a* is pushed into the bladder 2. Further note that the flap valve seal 10*b* sits in a groove cut into the base of the pump body 15. The flap disk 10 can be, for example, a thin piece of flexible plastic (e.g., polyester) about 0.3 mm (300 microns) thick. Other resilient flexible materials and thicknesses can be used here, so long as the pressure generated by the pumping mechanism is sufficient to force air into the bladder 2, and flow in the opposite direction is prevented.

As can be seen, the pump body 15 mounts within housing 1 so that the pump plunger 3*b* is exposed for actuation by the product user. The bladder 2 is fitted about the pump body 15 base during assembly, thereby creating a flexible barrier between the pump assembly and the internal reservoir 6. Note that housing 1 can secure and seal the bladder 2 in place by pressing the bladder 2 against the pump body 15 at various contact points. Alternatively, or in addition to, the bladder 2 can be sealed in place on the pump body 15 base using any conventional means (e.g., rubber cement). Plastic injection molding techniques can be used to make the pump mechanism components, although other manufacturing techniques can be used here as well, depending on the type of materials used.

In operation, the user holds the applicator and depresses the plunger 3*b* against the force exerted by the plunger spring 17. Note that in the down stroke of the pump cycle, the user's finger covers the plunger inlet port 16*a*. Thus, air contained in the pump chamber 3*a* is forced through the outlet passages 12, through the flap valve 10, and into the bladder 2. This air pumped into the bladder 2 expands it thereby pressurizing the product in the internal reservoir 6. For the up stroke of the pump cycle, the user releases the plunger 3*b*, thereby allowing the plunger spring 17 to operate and return the plunger 3*b* to its up position. Note that as the plunger 3*b* moves to its upper position, air flows from outside the device, through the plunger inlet port 16*a* and into the pump chamber 3*a* via the vented plunger shaft 16*b*. Further note that as the vented plunger shaft 16*b* has at least one flattened side so that air within the plunger spring housing 17 can pass along side the shaft 16*b* during the up and down strokes of the pump cycle. Further note that the plunger seal 14 is received into a chamfered notch formed at the top of the pump chamber 3*a*, so as to provide a stop position for the plunger 3*b* at the top of the pump cycle. Such a configuration allows the user to depress the plunger 3*b* multiple times to increase the pressure within the bladder 2, and numerous variations will be apparent in light of this disclosure.

As the pressure within the bladder 2 increases, so does the internal product pressure. This forces the product within the reservoir 6 to flow out the flow holes 1*a* of the housing 1, and against the jacket 4. This outward flow in-turn allows the product to slowly migrate beneath the jacket 4, and through the flow holes 4*a*. The flowing product will therefore eventually reach the porous secondary jacket 5, and be available for its intended purpose (e.g. bathing or application to patient's skin). Product migration from the reservoir 6 will diminish and slow as the product is dispensed, and flow will eventually cease due to inadequate internal pressure. At this time, a number of pump cycles could be repeated to recharge the internal pressure if so desired. As will be appreciated in light of this disclosure, the pumping assembly and flow hole/porosity scheme can be configured for different dispensing amounts.

As previously discussed, the secondary jacket 5 and/or jacket 4 may work in conjunction with the housing 1 and/or each other to create one or more "one-way valves." Such valves would allow the product to easily flow from flow holes 1*a* when the contents are pressurized, but close to restrict "back-flow" of outer surface materials such as water or other washing fluids into the internal reservoir 6. Individual jacket 4 segments can also be provided, such as narrow bands over each set of housing flow holes 1*a* (in lieu of a one piece jacket).

In one particular embodiment, the jacket 4 is an elastomeric tube with flow holes 4*a*, and is wrapped snugly around four sides of the housing 1. The flow holes 1*a* of the housing 1 would normally allow product to flow unrestrained from the internal reservoir 6 to the outer surface of the housing 1, but the jacket 4 substantially blocks those openings when there is little or no pressure on the product within the applicator. The flow holes 4*a* of jacket 4 are offset from the flow holes 1*a* in the housing 1. Thus, when the product within the applicator is pressurized, it will effectively shift the jacket 4 away from the flow holes 1*a* thereby allowing product to flow outwardly beneath the jacket 4 until it escapes from the flow holes 4*a*. The product continues to migrate and spread outwardly beneath the jacket 5, and eventually finds its way through the porous secondary jacket 5 (e.g., terry cloth) to the outer surface where it can be transferred to the target surface, such as the skin of a patient or bather.

Alternatively, the jacket layers 4 and or 5 can be made from fabric. Numerous fabric densities or EPI (ends per square inch) and material types are possible here, so as to provide a desired flow rate. This outer jacket may also provide an effective outer reservoir, where secondary fluids such as water and the dispensed product can intermingle. While pressurized product will flow through the jacket(s) from the internal reservoir 6, the secondary fluids will not be allowed to flow in the opposite direction (through the fabric and into reservoir 6). In this sense, the weave of the jacket can be adapted to provide a boundary layer.

Note that the porosity of the jackets 4 and 5 may or may not be a natural feature of the jacket material. Pores may be created by piercing, stamping, slicing, or otherwise altering the natural material. Recall that the secondary jacket 5 and/or jacket 4 may totally enclose the housing 1 or cover only specific surfaces of the housing 1, such as leaving opposite ends of the housing uncovered for simplicity and/or access to product features such as pumps, actuators, fill valves or the like. The secondary jacket 5 and/or jacket 4 may be fixtured in place by jacket tension. Such tension may be created, for example, by stretching the jacket over the housing, or by shrinking the jacket onto the housing (e.g., using heat shrinkable materials as previously discussed). Other methods such as adhesives may also be employed to fixture and/or seal housing jackets in place. Further note that the features of housing jacket 4 and secondary jacket 5 can be integrated into a single housing jacket (e.g., terry cloth with an elastomer backing), which can then be fitted over the housing 1.

Bladder Pressure Release Mechanism and Product Refill

After the product in the internal reservoir is depleted (or after assembly of the applicator), the device may be loaded/reloaded with product (e.g., liquid soap or a skin treatment). Note that the bladder 2 should be substantially contracted during the filling process. As such, a pressure release mechanism can be activated by the user. For example, during the loading process, the user can pull-out the plunger 3*b* (e.g., by pulling on a pull-tab threaded into the plunger inlet port 16*a*), and use a pin to push the flap valve disk 10 open, thereby allowing pressure within the bladder 2 to escape.

Alternatively, the applicator can be configured with a dedicated bladder pressure release mechanism, that can be activated by the user during refilling operations or as desired. One such embodiment is shown in FIGS. 1*h* through 1*n*. In this particular example, the plunger 3*b* includes two valve release pins 20. For a bladder 2 discharge operation, the plunger 3*b* is turned so that each release pin 20 aligns with a corresponding outlet passage 12 at the base of the pump body 15. Thus, when the plunger 3*b* is fully depressed, the valve release pins 20 pass through the outlet passages 12, and press the flap valve disk 10 open, thereby allowing pressure in the bladder 2 to release. Note that there is sufficient space for the released air to flow around the pins 20, between the plunger 3*b* and the bottom of the pump chamber 3*a*, and then down the flattened sides of the vented plunger shaft 16*b*, and out through the plunger inlet port 16*a*. For a bladder pump operation, the plunger 3*b* is turned so that the release pins 20 do not align with the outlet passages 12 at the base of the pump body 15. Thus, when the plunger 3*b* is fully depressed for the down stroke of a pump cycle, the valve release pins 20 hit the bottom of the pump chamber 3*a* (as opposed to pressing the flap valve disk 10 open).

As will be apparent, key 25 can be used to turn the plunger 3*b* into the discharge or pump positions. In particular, the key slots 25*a* of plunger 3*b* are configured to receive the prongs of the key 25. Once engaged, the plunger 3*b* can be turned by turning the key 25. Markings on the housing and plunger 3*b* can designate the "discharge" and "pump" positions. Various other discharge mechanisms will be apparent in light of this disclosure. For instance, a vacuum could be employed to substantially remove all air with the bladder 2, if so desired. In such a case, the plunger 3*b* could be removed or otherwise configured so that a vacuum assembly could engage the pump chamber, open the flap valve disk 10 (e.g., using release pins as previously discussed, and pump out the bladder 2. In any case, the bladder 2 can be substantially contracted. Recall, however, that disposable applications would not require discharge or refilling operations.

One method of product loading is to position the applicator with the plunger end facing downward, so that the fill plug/opening 8 is facing upward. In general, any conventional dispensing equipment (e.g., dispensing needles) and/or dispensing techniques (e.g., pouring) can be used here, depending on the size of the fill hole/plug 8. After product loading, the fill plug 8 is installed into the fill hole to block and seal the opening. One example embodiment uses a ball with an interference fit to block the opening, which results in a one-use product (e.g., fill the reservoir 6 and then install the ball into the smaller fill hole). Alternatively, a resilient self-resealing valve could be installed that enables refilling (as discussed in reference to FIG. 1*c*).

Various integrated plunger/pump chamber configurations are shown in FIGS. 1*a–n*, but other techniques may also be employed. The applicator may utilize many different internal devices to activate it. For example, a pressurized container may be opened, broken, pierced, dissolved or otherwise forced into releasing its contents at least partially thereby pressurizing the bladder 2 or otherwise pressurizing the product in the reservoir. Alternatively, the by-products of a chemical reaction (e.g., synthesis or combustion) may be used to pressurize the product. Further, note that the housing 1 could be made from materials other than plastic or elastomers, such as machined metal (e.g., titanium or other suitable long term use material). Generally stated, the material choice for housing 1 will depend on intended use (e.g., disposable or non-disposable) and desired cost per unit. Numerous configurations are possible in light of this disclosure.

Charging Station—Pressure

Figure 2:
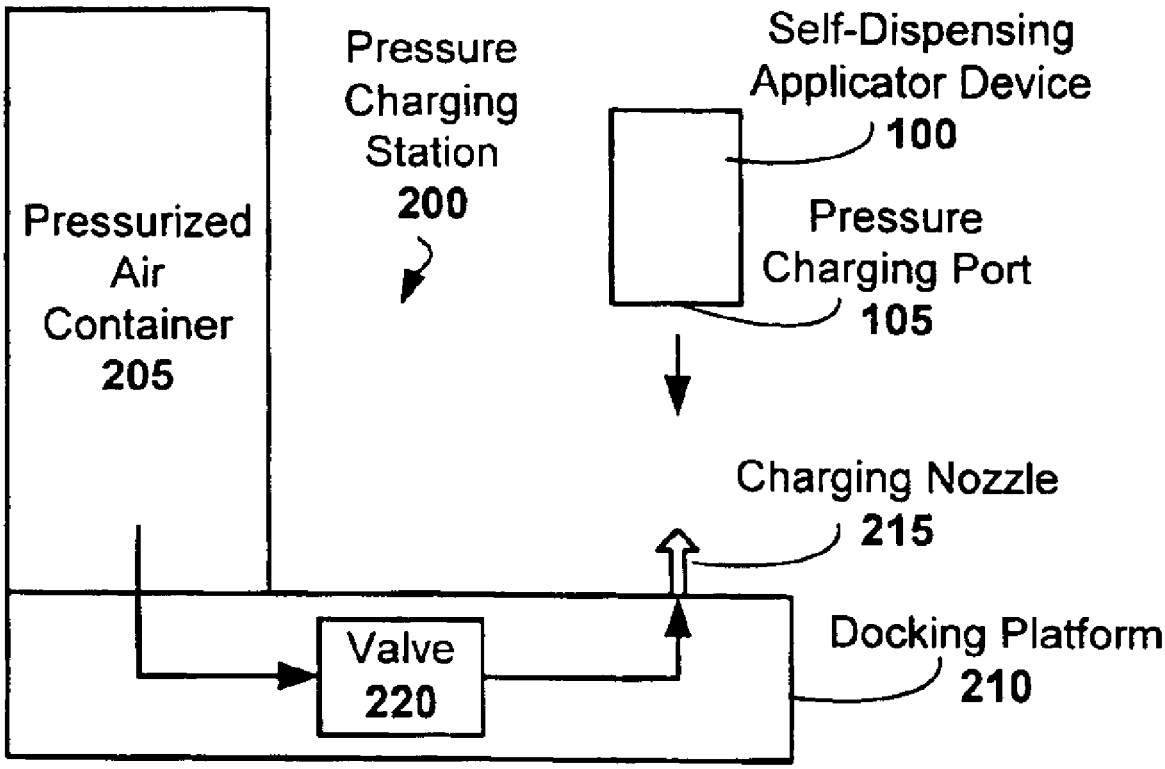
FIG. 2 illustrates an external pressure charging station configured in accordance with one embodiment of the present invention.

FIG. 2 illustrates an external pressure charging station 200 configured in accordance with one embodiment of the present invention. As can be seen, the station 200 includes a pressurized air container 205, a docking platform 210, a charging nozzle 215, and a one-way valve 220. In addition to these main features, additional features such as conduit or tubing for coupling the container 205 to the valve 220 to the nozzle 215, switches, seals, clamps, pressure regulators, pressure gauges, filling chucks, and release/safety valves may also be included in the station 200 design.

Such a charging station 200 can be used as an alternate pressure inducing mechanism to the plunger/pump chamber configurations previously discussed. In this particular scheme, the self-dispensing applicator 100 is configured with a pressure charging port 105. This port 105 can be operatively coupled, for example, to a bladder 2, thereby providing indirect pressurization of the product. In one embodiment, the pressure charging port 105 is a self-sealing valve, such as that described in reference to FIGS. 1*c* and 1*d*. Thus, the port 105 will yield to the charging nozzle 215 when the device 100 is pressed on to the nozzle 215 on the docking platform 210. The force of the device 100 on the nozzle 215 can be used to trigger the valve 220 to open, thereby allowing air from container 205 to flow and pressurize the bladder 2. Alternatively, the valve 220 can be adapted to sense the lack of pressure once the device 100 is docked on the nozzle 215, and to open until the internal bladder pressure of the device 100 reaches a certain level (similar to a self-help tire inflation system at a gas station). Once the pressure charging is complete, the device can be withdrawn from the nozzle 215, and is ready for use.

Charging Station—Product

Figure 3A:
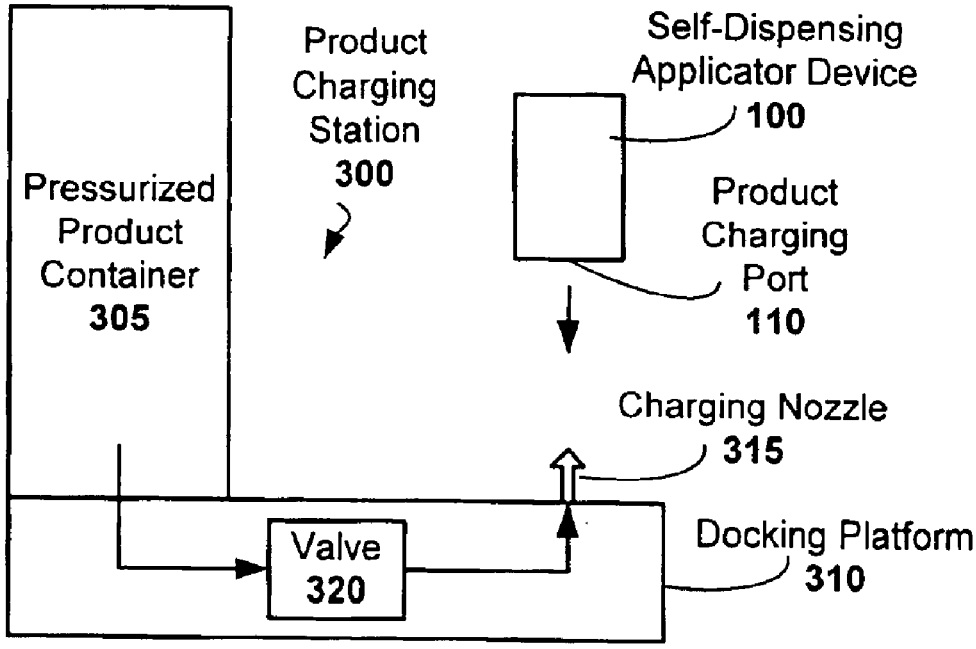
FIGS. 3*a* and 3*b* each illustrate an external product charging station configured in accordance with an embodiment of the present invention.

FIG. 3*a* illustrates an external product charging station configured in accordance with an embodiment of the present invention. As can be seen, the station 300 includes a pressurized product container 305, a docking platform 310, a charging nozzle 315, and a one-way valve 320. In addition to these main features, additional features such as conduit or tubing for coupling the container 305 to the valve 320 to the nozzle 315, seals, switches, clamps, pressure regulators, pressure gauges, filling chucks, and release/safety valves may also be included in the station 300 design.

In this particular scheme, the self-dispensing applicator 100 is configured with a product charging port 110. This port 110 is operatively coupled to the internal reservoir 6. In one embodiment, this product charging port 110 is a self-sealing valve, such as that described in reference to FIGS. 1*c* and 1*d*. Thus, the port 110 will yield to the charging nozzle 315 when the device 100 is pressed on to the nozzle 315 on the docking platform 310. The force of the device 100 on the nozzle 315 can be used to trigger the valve 320 to open, thereby allowing product from container 305 to flow into the internal reservoir 6 of the device. Alternatively, the valve 320 can be adapted to sense the lack of pressure once the device 100 is docked on the nozzle 315, and to open until the internal reservoir pressure of the device 100 reaches a certain level. Once the product charging is complete, the device can be withdrawn from the nozzle 315, and is ready for it next use.

Figure 3B:
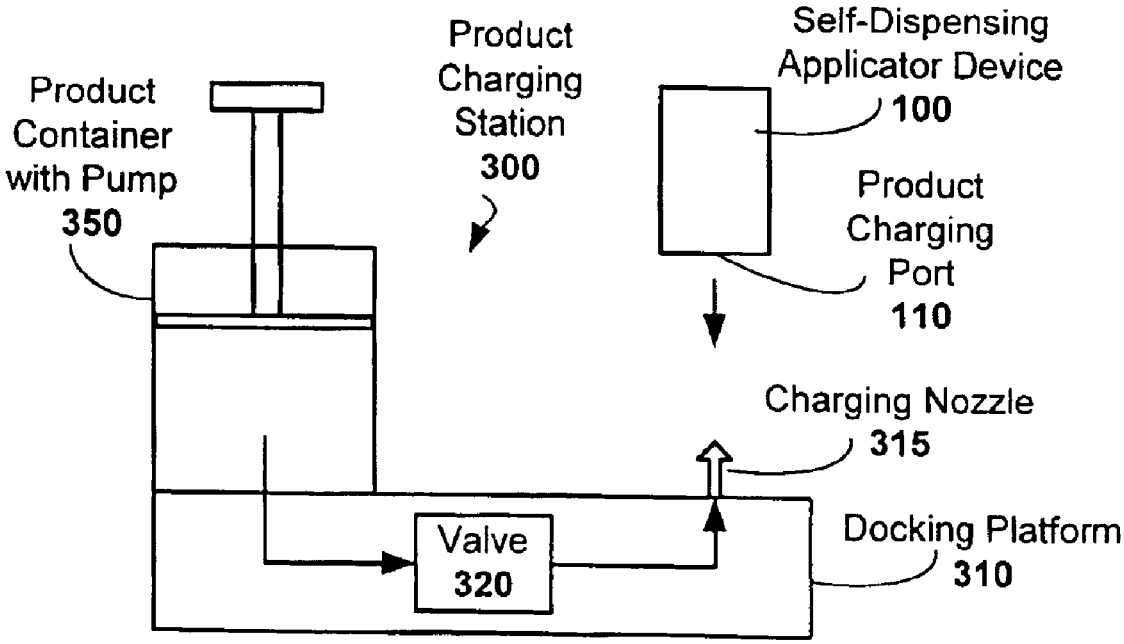

FIG. 3*b* illustrates an external product charging station configured in accordance with another embodiment of the present invention. This configuration is similar to that of FIG. 3*a*, except here there is a product container with a pump 350 as opposed to a pressurized product container 305. Thus, the user must pump the product container 350 to force the product into the self-dispensing applicator 100. Other than the manual pumping, the principle of operation is the same as that described in reference to FIG. 3*a*. Note, however, that valve 320 may be eliminated from this configuration if the product charging station 300 is used for replenishing the reservoir 6 only (i.e., not for pressurizing the product).

Further note that in an embodiment which employs a permanently pressurized and/or sealed bladder, the act of charging the reservoir 6 with product will effectively compress the pressurized bladder, and initiate the flow of that product through the porosity of the housing 1 and any jacketing (combination of direct and indirect pressurization). In an embodiment having no bladder, the mere act of charging the internal reservoir 6 to a certain pressure will initiate the product flow (direct pressurization). In this case, the elasticity of the applicator's housing 1 causes the internal pressure and outward product flow. In an embodiment where the bladder 2 is not yet pressurized, the act a charging reservoir 6 with product will not initiate the product flow. Here, the user must activate the flow by subsequently pressuring the bladder 2 (indirect pressurization). This can be done, for example, with a plunger/pump chamber configuration or a pressurized charging station 200 as described herein.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A hand-held self-dispensing applicator device for dispensing a dispensable non-powder product for the purpose of cleaning or treating a target surface, the device comprising:

a housing having an outer surface and an internal reservoir for holding the product, wherein a plurality of pores fluidly couple the internal reservoir and the outer surface of the housing;

a bladder within the internal reservoir; and a pressure inducing mechanism operatively coupled to the bladder, and adapted to increase pressure within the bladder so as to provide a positive pressure in the internal reservoir, thereby causing the product to flow through the plurality of pores to the outer surface of the housing.

2. The device of claim 1 further comprising:

a housing jacket disposed on the outer surface of the housing, the jacket adapted to provide a soft and resilient application surface.

3. The device of claim 1 further comprising:

a housing jacket disposed on the outer surface of the housing, the jacket adapted to control the flow of the product through the plurality of pores to the outer surface of the housing.

4. The device of claim 3 wherein the housing jacket includes a number of flow holes that are substantially offset from the plurality of pores.

5. The device of claim 1 further comprising:

a housing jacket disposed on the outer surface of the housing, the jacket adapted to operate in conjunction with the positive pressure in the internal reservoir to control the flow of the product through the plurality of pores, as well as to inhibit flow of secondary fluids into the internal reservoir.

6. The device of claim 1 further comprising:

a housing jacket disposed on the outer surface of the housing, the jacket adapted to operate in conjunction with physical attributes of the product to control the flow of the product through the plurality of pores.

7. The device of claim 1 wherein the pressure inducing mechanism includes at least one of a pump chamber and plunger arrangement, a one-way valve scheme, a seal and retention scheme, and an external charging station.

8. The device of claim 1 where the pressure inducing mechanism includes a pressurized container that is forced into releasing its contents at least partially thereby increasing the pressure within the bladder.

9. The device of claim 1 where the pressure inducing mechanism is adapted to exploit by-products of a chemical reaction to increase the pressure within the bladder.

10. The device of claim 1 where the pressure inducing mechanism is activated by a user.

11. A hand-held self-dispensing applicator device for dispensing a dispensable non-powder product for the purpose of cleaning or treating a target surface, the device comprising:

a housing having an outer surface and an internal reservoir for holding the product, wherein a plurality of pores fluidly couple the internal reservoir and the outer surface of the housing; and a pressure inducing mechanism adapted to provide a positive pressure in the internal reservoir that causes the product in the internal reservoir to continuously flow through the plurality of pores to the outer surface of the housing for a period of 10 seconds or more.

12. The device of claim 11 wherein the pressure inducing mechanism includes at least one of a pump chamber and plunger arrangement, a one-way valve scheme, a seal and retention scheme, and an external charging station.

13. The device of claim 11 further comprising:

a housing jacket disposed on the outer surface of the housing, the jacket adapted to control the flow of the product through the plurality of pores to the outer surface of the housing.

14. The device of claim 13 wherein the housing jacket includes a number of flow holes that are substantially offset from the plurality of pores.

15. The device of claim 11 further comprising:

a housing jacket disposed on the outer surface of the housing, the jacket adapted to operate in conjunction with the positive pressure in the internal reservoir to control the flow of the product through the plurality of pores.

16. The device of claim 11 further comprising:

a housing jacket disposed on the outer surface of the housing, the jacket adapted to operate in conjunction with physical attributes of the product to control the flow of the product through the plurality of pores.

17. The device of claim 11 where the pressure inducing mechanism is activated by a user.

18. The device of claim 11 wherein the pressure inducing mechanism includes a pump chamber and plunger arrangement configured to operate in conjunction with a one-way flap valve.

19. A hand-held self-dispensing applicator device for dispensing a dispensable non-powder product for the purpose of cleaning or treating a target surface, the device comprising:

a housing having an outer surface, and an internal reservoir for holding the product, wherein openings of the housing fluidly couple the internal reservoir and the outer surface; and a bladder within the internal reservoir, configured to provide a positive pressure in the internal reservoir, which causes the product in the internal reservoir to flow to the outer surface of the housing.

20. The device of claim 19 wherein the openings of the housing are provided by a plurality of flow holes in the outer surface.

21. A hand-held self-dispensing applicator device for dispensing a dispensable non-powder product for the purpose of cleaning or treating a target surface, the device comprising:

a housing having an outer surface, and an internal reservoir for holding the product, wherein openings of the housing fluidly couple the internal reservoir and the outer surface;

wherein the internal reservoir can be pressurized to provide a positive pressure in the internal reservoir that causes the product in the internal reservoir to continuously flow to the outer surface of the housing for a period of 10 seconds or more.

22. The device of claim 21 wherein the openings of the housing are provided by a plurality of flow holes in the outer surface.

23. The device of claim 21 further comprising:

a housing jacket disposed on the outer surface of the housing, the jacket adapted to control the flow of the product to the outer surface of the housing.

24. The device of claim 21 further comprising:

a housing jacket disposed on the outer surface of the housing, the jacket adapted to restrict the flow of the product to the outer surface of the housing.

25. The device of claim 21 further comprising:

a housing jacket disposed on the outer surface of the housing, the jacket adapted to operate in conjunction with the positive pressure in the internal reservoir to control the flow of the product to the outer surface of the housing, as well as to inhibit flow of secondary fluids into the internal reservoir.

26. The device of claim 21 further comprising:

a housing jacket disposed on the outer surface of the housing, the jacket adapted to operate in conjunction with physical attributes of the product to control the flow of the product to the outer surface of the housing.

27. A hand-held self-dispensing applicator device for dispensing a dispensable non-powder product for the purpose of cleaning or treating a target surface, the device comprising:

a housing having an outer surface and an internal reservoir for holding the product, wherein a plurality of pores fluidly couple the internal reservoir and the outer surface; and a pump chamber and plunger arrangement configured to operate in conjunction with a one-way valve to provide a positive pressure in the internal reservoir which causes the product in the internal reservoir to continuously flow through the plurality of pores to the outer surface of the housing for a period of 10 seconds of more.

28. The device of claim 27 further comprising:

a bladder within the internal reservoir and operatively coupled to the pump chamber, thereby enabling expansion of the bladder so as to provide the positive pressure in the internal reservoir.

29. The device of claim 27 further comprising:

a housing jacket disposed on the outer surface of the housing, the jacket adapted to operate in conjunction with the positive pressure in the internal reservoir to control the flow of the product through the plurality of pores, and to inhibit flow of secondary fluids into the internal reservoir.

30. The device of claim 29 wherein the housing jacket includes a number of flow holes that are substantially offset from the plurality of pores.

* * * * *